US005562500A

United States Patent [19]

Tsukakoshi

[11] Patent Number: 5,562,500

[45] Date of Patent: Oct. 8, 1996

[54] DOUBLE LOCK CONNECTOR

[75] Inventor: Masao Tsukakoshi, Machida, Japan

[73] Assignee: The Whitaker Corporation, Wilmington, Del.

[21] Appl. No.: 538,057

[22] Filed: Oct. 2, 1995

Related U.S. Application Data

[63] Continuation of Ser. No. 424,240, Apr. 19, 1995, abandoned, which is a continuation of Ser. No. 271,391, Jul. 6, 1994, abandoned.

[30] Foreign Application Priority Data

Aug. 24, 1993 [JP] Japan ..... 5-059375 U

[51] Int. Cl.[6] ..... H01R 13/436

[52] U.S. Cl. ..... 439/752

[58] Field of Search ..... 439/752

[56] References Cited

U.S. PATENT DOCUMENTS 4,772,229 9/1988 Nix et al. ..... 439/752

FOREIGN PATENT DOCUMENTS 5-23440 3/1993 Japan .

*Primary Examiner*—Gary F. Paumen

[57] ABSTRACT

The double lock device 1 having latching arms 2 and through holes 12 located in the vicinity of the ends of the latching arms 2 is placed in the connector housing 50. In a normal state, the lugs 10 of the latching arms 2 are locked in depressions 54 of the housing 50. In order to release this locking, the latching arms 2 are bent by a tool 80 whose tip 82 becomes engaged with the through hole 12. The double lock device is extracted by moving the tool 80 in the direction shown by arrow B.

22 Claims, 4 Drawing Sheets

DOUBLE LOCK CONNECTOR

This application is a Continuation of application Ser. No. 08/424/240 filed Apr. 19, 1995, now abandoned, in turn, a Continuation of application Ser. No. 08/271,391 filed Jul. 6, 1994, now abandoned.

FIELD OF THE INVENTION

This invention relates to double-lock connectors, especially to double-lock connectors having a double-lock device with a latching arm.

BACKGROUND OF THE INVENTION

Contacts arrayed inside connectors are usually placed into the contact cavity by means of a housing lance or some other device. Double lock devices are generally used in order to increase the retaining force holding these contacts inside the housing. A number of methods for latching in double lock devices has been offered ranging from a simple fitting of a protrusion in a notch to devices incorporating springy elements, such as, for example, described in the Japanese Utility Model Publication No. 1992-23440.

For example, FIG. 5 represents a cross section of a conventional connector in which a double lock device with a latching arm is used. This connector 100 consists of a housing 102, a double lock 130 and a cover 120. Contacts and the cavity in which the contacts are retained are not shown in the drawing. The double lock device 130 is of approximately rectangular shape, and in the drawing it is shown in the state when it is completely locked in the housing 102. At approximately midpoint of the double lock device 130, there are two latching arms 132 and 142 extending in opposite directions. In the vicinity of the free ends of the latching arms 132 and 142, lugs 134 and 144 respectively are provided. The double lock device 130 is inserted in the cavity 106 of the housing 102 from the side surface 104 of the housing 102. First, the lug 144 becomes engaged with a lug 108 of the housing 102, thus providing a state of temporary latching of the double lock device 130. Next, when the double lock device 130 is inserted even farther in, the lug 134 of the latching arm 132 becomes engaged with a lug 110 of the housing 102, thus completing the latching. Due to this complete latching, the contacts are prevented from being pulled out in the direction of their axes.

Rarely, but in some cases, because of a damaged contact or improper wiring, it is necessary to remove the double lock device after it has been inserted. In such cases, the latching between lugs 134 and 110 is released by bending the latching arm 132 in the direction shown by the arrow A by pushing its end by a tip of a screw driver or some other tool. However, this design has the disadvantage consisting in that the latching condition between the latching arm 132 and the lug 110 can easily resume, thus making the task of removal of the double lock device 130 rather difficult.

The double-lock connector according to this invention was conceived having in mind elimination of the above mentioned disadvantage, and it has the following structure.

SUMMARY OF THE INVENTION

The double-lock connector according to this invention comprises a housing having a double lock device with latching arm locking contacts which are retained inside the housing by means of a latching device, characterized by the fact that the double-lock device is equipped with a through hole located in the vicinity of the free end of the latching arm which can be reached by a tool when it is necessary to release the latching engagement bending said latching arm by the tool.

BRIEF DESCRIPTION OF THE DRAWINGS

Embodiments of the invention will now be descriped by way of example with reference to the accompanying drawings, in which:

FIG. 4 (B) is a longitudinal cross section of another embodiment of the double lock device in a state when it is extracted with a help of a tool.

FIG. 5 is a longitudinal cross section of a conventional double-lock connector.

DETAILED DESCRIPTION OF THE INVENTION

Figure 1:
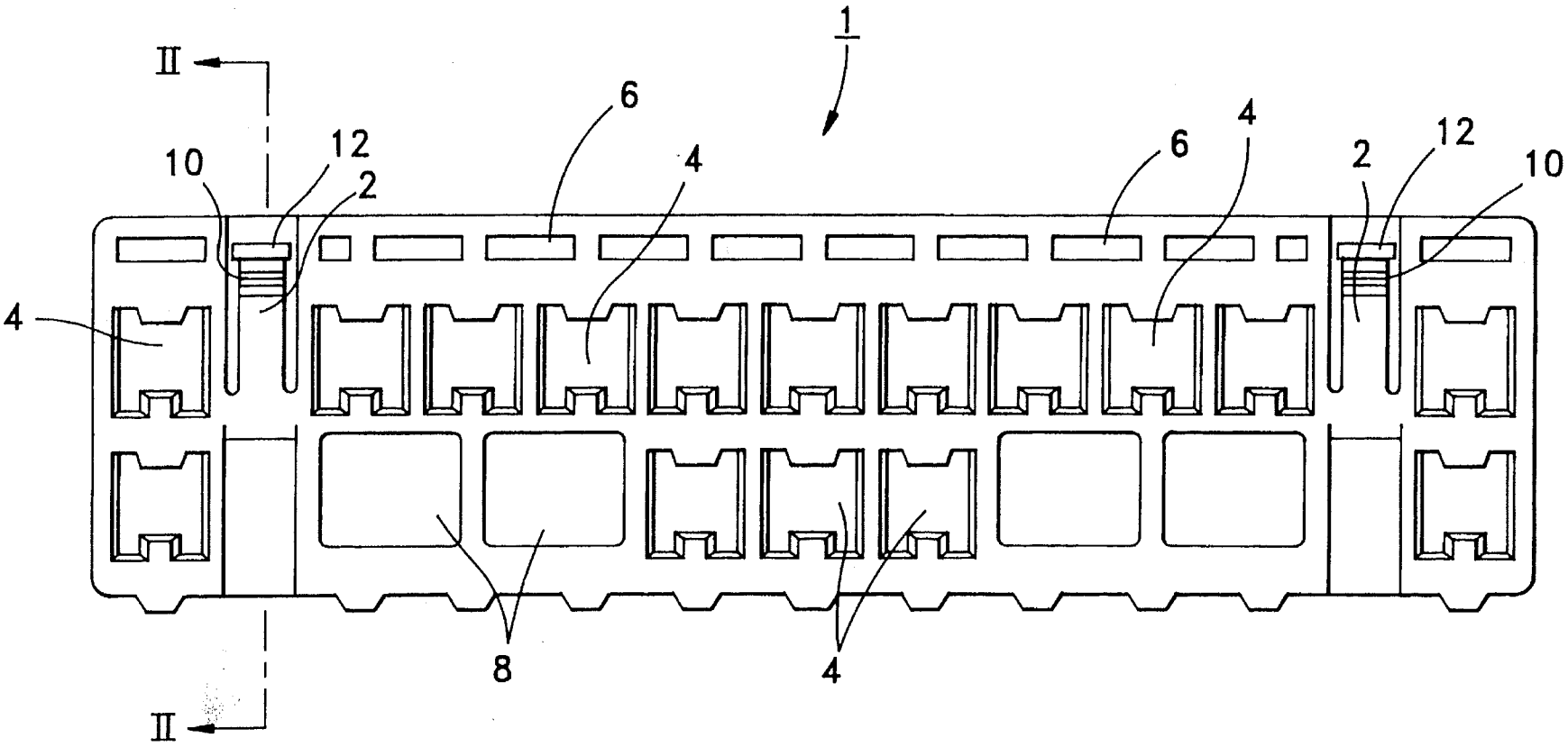
FIG. 1 is a front view of the double-lock connector according to this invention.

FIG. 1 is the front view of a double lock device 1 used in the double-lock connector according to this invention. The double lock device 1 is of approximately rectangular shape and it has at both ends cantilevered latching arms 2. The latching arms 2 can move in the direction perpendicular to the plane of the drawing. Rectangular openings 4 are openings for the insertion of contacts, not shown in the drawing. Items 6 and 8 are openings made in the double lock device 1. The latching arms 2 have lugs 10. Through holes 12 are made in the double lock device behind the latching arms 2. The design of these through holes can be clearly seen in FIG. 2.

Figure 2:
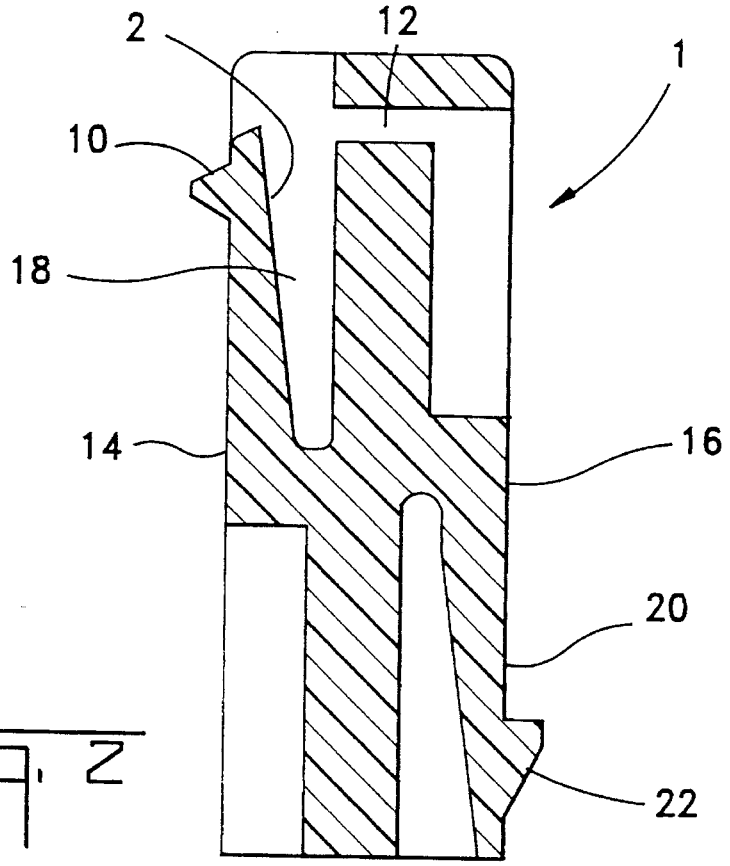
FIG. 2 is a longitudinal cross section of the double lock device used in the double-lock connector according to this invention.

FIG. 2 is a cross section of the double lock device 1 shown in FIG. 1 along the line II—II. The latching arms 2 extend from approximately the middle point of the double lock device 1 along its side surface 14. An empty space 18 formed behind the latching arm 2 is provided to make room for the bending of the latching arm 2. A through hole 12 is made in the body of the double lock device 1 behind the free end of the latching arm 2. Along the side surface 16, a latching arm 20 having a lug 22 is made extending in the direction opposite to that of the latching arm 2. The lug 22 forms a temporary locking of the double lock device 1 when it is inserted in the housing 50 by interfering with the housing.

Figure 3:
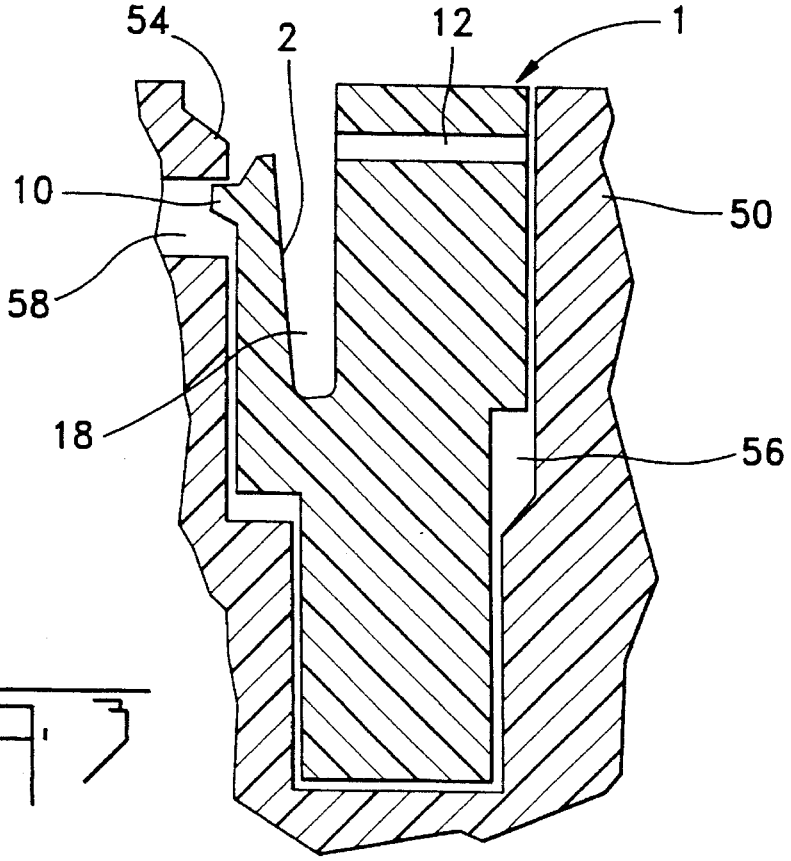
FIG. 3 is a longitudinal cross section of the double lock device in a state when it is inserted in the housing.

FIG. 3 is a schematic longitudinal cross section of the above mentioned double lock device 1 in the state when it is inserted in the connector housing 50. In this drawing the latching arm 20 for temporary locking is not shown for simplicity. When the double lock device 1 is inserted in the cavity 56 of the housing 50, the lug 10 of the latching arm 2 is deflected by protrusion 54 of the housing 50 in the direction of the empty space 18. After it passes the protrusion 54, the latching arm 2, due to the spring action, returns to its original position, and the lug 10 locks in the depression 58 of the housing 50. This locked state is shown in FIG. 3.

Figure 4A:
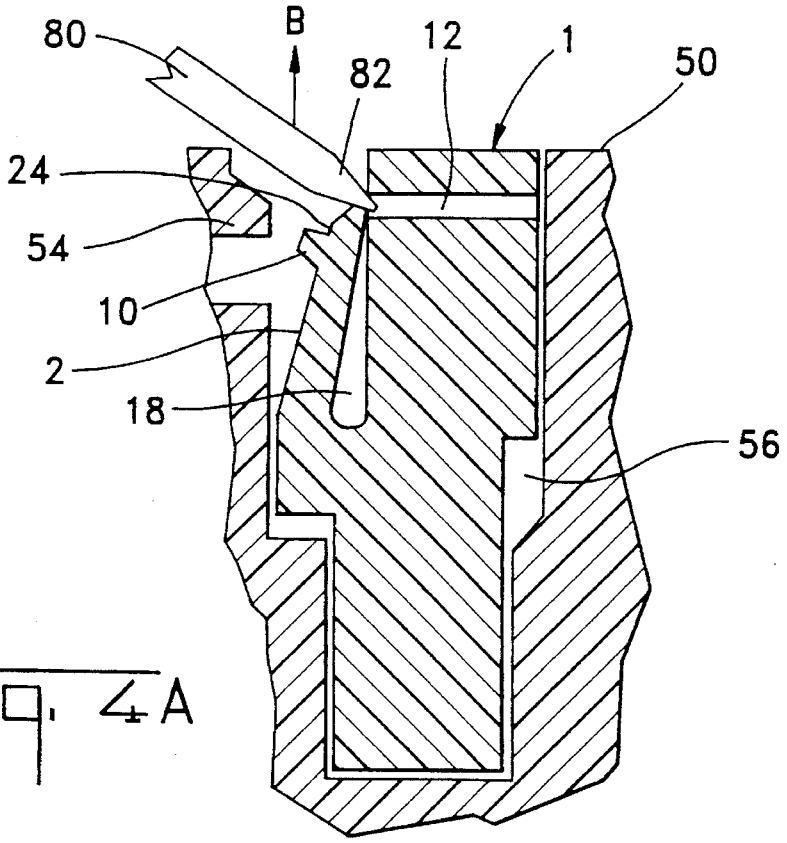
FIG. 4 (A) is a longitudinal cross section of the double lock device in a state when it is extracted with a help of a tool.
Figure 4B:
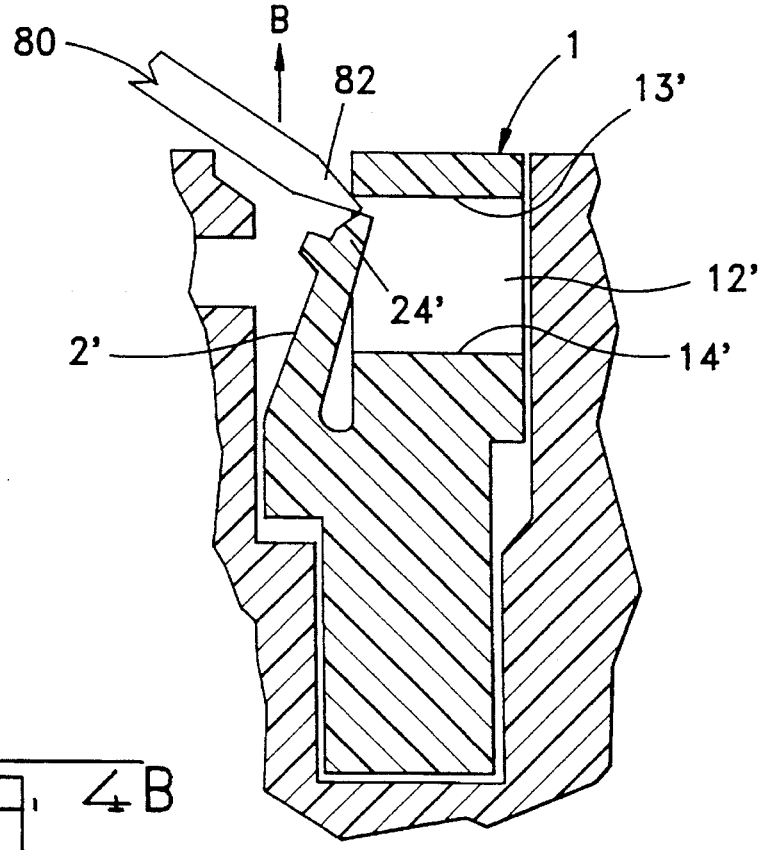
Figure 7:
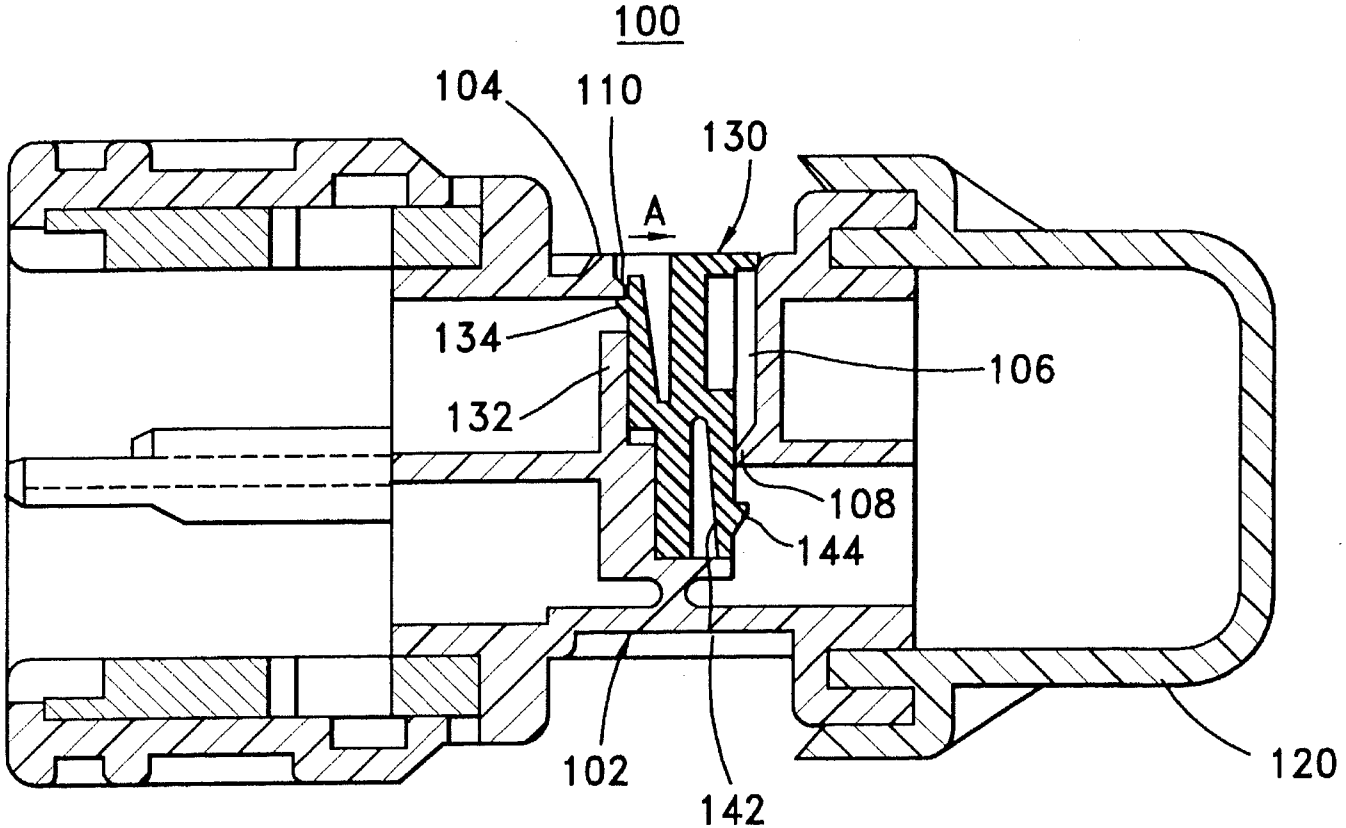
FIG. 7 (PRIOR ART)

FIG. 4 (A) is a longitudinal cross section of the double lock device 1 shown in FIG. 3 in a state when it is removed from the housing 50. In this state, the free end 24 of the latching arm 2 is bent out in the direction of the empty space 18 by pushing it with the tip 82 of a screw driver or some other tool 80. Due to this action, the lug 10 of the latching arm 2 is released from the depression 54 of the housing 50, and the tip 82 of the tool 80 penetrates the through hole 12. After that, the tool 80 is moved in the direction indicated by the arrow B, thus removing the double lock device 1 from the cavity 56 of the housing 50. A modification of this embodiment provides for a better engagement of the tool 80 with the upper wall 13 of this through hole 12 is explained next with reference to FIG. 4 (B).

FIG. 4 (B) represents another embodiment of the double lock device 1' having a different configuration of the through hole 12'. This through hole 12' has a larger opening so that its bottom wall 14' comes to approximately a middle point of the latching arm 2'. Because of this, the free end 24' of the latching arm 2' can be easily bent inside the through hole 12', and the tip 84 of the tool 80 can be easily engaged with the upper wall 13' of the through hole 12', thus making removal of the double lock device 1' in the direction of the arrow B more reliable.

Above, we gave detailed explanations concerning preferred embodiments of this invention, however it is understood that the invention also includes various modifications. For example, the space in which the tool tip is inserted may be a cavity, rather than a through hole, of the housing. It also may be made in the form of protrusions extending from the housing.

The double-lock connector according to this invention having a double lock device with a latching arm which can be bent by a tool has the following effect due to the fact that a means is provided in this double lock device for engagement of the tool tip with the double lock device.

The double lock device can be easily extracted in the process of a simple operation. There is no danger of damaging the latching part during removal. Therefore, the reliability of the locking mechanism does not decline with the use.

I claim:

1. A double lock connector comprising:

an elongate, generally rectangular housing having a cavity extending through a side wall of the connector at a substantially right angle with respect to the side wall, a generally rectangular, flat double lock device to be received substantially within the cavity, having an integral latching arm for retaining said device in said cavity of said housing, and having a plurality of openings to receive terminals therein, and a tool receiving area on said double lock device behind said latching arm wherein said tool receiving area is a through hole, and whereby said tool receiving area is accessible by a tool from the side wall of said housing to allow deflection of said latching arm, so that said double lock device can be unlatched and removed from said housing using said tool in cooperation with said tool receiving area.

2. The connector of claim 1, wherein latching arm has a leg.

3. The connector of claim 1, wherein said through hole has a bottom wall which is at approximately a middle point of said latching arm.

4. The connector of claim 3, wherein said latching arm can be bent inside said through hole and said tool can engage an upper wall of said through hole.

5. The double lock connector of claim 1, wherein the tool receiving area is large enough to deflect a free end of the latch arm thereinto.

6. The double lock connector of claim 1, wherein said double lock device is substantially flush with said side wall of said housing in a finally locked position thereof.

7. The double lock connector of claim 1, wherein said double lock device has at least one additional latch arm for retaining said double lock member in a preliminary locking position.

8. A double lock connector, comprising:

a housing having a cavity extending through a side wall of the housing at a substantially right angle with respect to the side wall;

a generally rectangular, flat double lock device to be received substantially within the cavity, the device having an integral latching arm for retaining the device in the cavity of the housing, and having a plurality of openings to receive terminals therein, the device having a space behind the latching arm to allow deflection of the latching arm for latching and unlatching; and a tool receiving area on the double lock device behind the latching arm wherein the tool receiving area is a through hole, and whereby the tool receiving area is accessible by a tool from the side wall of the housing to allow deflection of said latching arm into the space behind the latching arm so that said double lock device can be unlatched and removed from said housing using the tool in cooperation with the tool receiving area.

9. The connector of claim 8, wherein the latching arm has a lug.

10. The connector of claim 8, wherein the through hole has a bottom wall which is at approximately a middle point of the latching arm.

11. The connector of claim 8, wherein the latching arm can be bent inside the through hole and the tool can engage an upper wall of the through hole.

12. The connector of claim 8, wherein the tool receiving area is large enough to allow deflection of a free end of the latch arm thereinto.

13. The connector of claim 8, wherein said double lock device is substantially flush with said side wall of said housing in a finally locked position thereof.

14. The connector of claim 8, wherein said double lock device has at least one additional latch arm for retaining said double lock member in a preliminary locking position.

15. A double lock connector, comprising:

a housing having a cavity extending through a side wall of the housing at a substantially right angle with respect to the side wall;

a generally rectangular, flat double lock device to be received substantially within the cavity, the device having an integral latching arm for retaining the device in the cavity of the housing, and having a plurality of openings to receive terminals therein, a back wall extending substantially parallel with the latching arm and being behind the latching arm, the device having a deflection space behind the latching arm to allow deflection of the latching arm for latching and unlatching, the deflection space being defined by the latching arm and the back wall; and a tool receiving cavity on the back wall behind the latching arm, and whereby the tool receiving area is accessible by a tool from the side wall of the housing to allow deflection of said latching arm into the space behind the latching arm so that said double lock device can be unlatched and removed from said housing using the tool in cooperation with the tool receiving area.

16. The connector of claim 15, wherein the tool receiving cavity is a through hole.

17. The connector of claim 15, wherein the latching arm has a lug.

18. The connector of claim 15, wherein the through hole has a bottom wall which is at approximately a middle point of the latching arm.

19. The connector of claim 15, wherein the latching arm can be bent inside the through hole and the tool can engage an upper wall of the through hole.

20. The connector of claim 15, wherein the tool receiving cavity is large enough to deflect a free end of the latch arm thereinto.

21. The connector of claim 15, wherein said double lock device is substantially flush with said side wall of said housing in a finally locked position thereof.

22. The connector of claim 15, wherein said double lock device has at least one additional latch arm for retaining said double lock member in a preliminary locking position.

* * * * *